US005923920A

United States Patent [19]

Ishida et al.

[11] Patent Number: 5,923,920

[45] Date of Patent: Jul. 13, 1999

[54] IMAGE FORMING APPARATUS FOR CONTROLLING PROCESSING CONDITIONS IN IMAGE FORMING PROCESS BY DETECTION OF TINER PATCH DENSITY FORMED ON PHOTORECEPTOR SURFACE

[75] Inventors: Toshihisa Ishida, Kashiba; Masayasu Narimatsu, Nara; Hideji Saiko, Kitakatsuragi-gun; Tomoko Nishino, Tenri; Katsuaki Sumida, Kashiba; Jitsuo Masuda, Yamatotakada; Hiroo Naoi, Yamatokoriyama, all of Japan

[73] Assignee: Sharp Kabushiki Kaisha, Osaka, Japan

[21] Appl. No.: 09/078,271

[22] Filed: May 13, 1998

[30] Foreign Application Priority Data

Jun. 2, 1997 [JP] Japan ..... 9-143806

[51] Int. Cl.[6] ..... G03G 15/00

[52] U.S. Cl. ..... 399/46; 399/45; 399/49; 399/72

[58] Field of Search ..... 399/49, 46, 45, 399/72

[56] References Cited

U.S. PATENT DOCUMENTS

| | | | |
|---|---|---|---|
| 4,684,243 | 8/1987 | Minor | 399/72 |
| 4,965,634 | 10/1990 | Bando | 399/49 |
| 4,980,723 | 12/1990 | Buddendeck et al. | 399/72 |
| 5,099,279 | 3/1992 | Shimizu | 399/49 |
| 5,307,119 | 4/1994 | Folkins et al. | 399/46 |

FOREIGN PATENT DOCUMENTS

| | | |
|---|---|---|
| 61-97665 | 5/1986 | Japan . |
| 6-19259 | 1/1994 | Japan . |
| 6-51551 | 2/1994 | Japan . |

*Primary Examiner*—S. Lee

*Attorney, Agent, or Firm*—Dike, Bronstein, Roberts & Cushman, LLP; David G. Conlin; George W. Neuner

[57] ABSTRACT

An image forming apparatus has an arrangement wherein a main charger includes a charger line corresponding to a region within a reference range on a surface of a photoreceptor and second charger lines corresponding to regions outside the reference range, and the first charger line within the reference range and the second charger lines outside the reference range are driven independently. The reference range is set on the surface of the photoreceptor as a width of a transported sheet which is most frequently used. In a processing control, in the case where toner patch density within the reference range becomes higher than toner patch density outside the reference range, an applied voltage with respect to the charger line within the reference range is increased relatively higher than an applied voltage with respect to the charger lines outside the reference range, thus uniformalizing the toner density with respect to the entire surface of the photoreceptor drum.

32 Claims, 16 Drawing Sheets

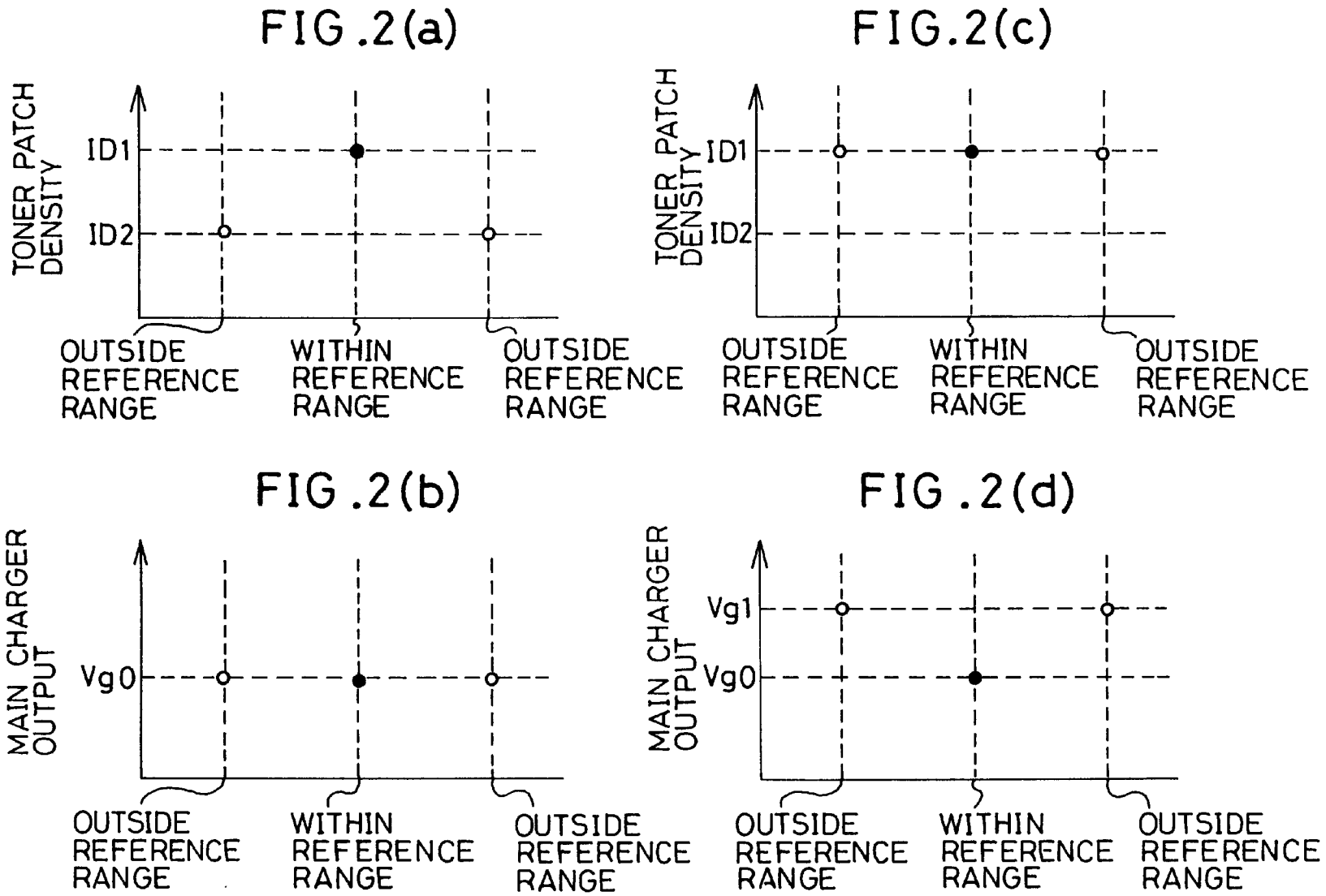
FIG.2(a)
TONER PATCH DENSITY
ID1
ID2
OUTSIDE REFERENCE RANGE
WITHIN REFERENCE RANGE
OUTSIDE REFERENCE RANGE
FIG.2(b)
MAIN CHARGER OUTPUT
Vg0
OUTSIDE REFERENCE RANGE
WITHIN REFERENCE RANGE
OUTSIDE REFERENCE RANGE
FIG.2(c)
TONER PATCH DENSITY
ID1
ID2
OUTSIDE REFERENCE RANGE
WITHIN REFERENCE RANGE
OUTSIDE REFERENCE RANGE
FIG.2(d)
MAIN CHARGER OUTPUT
Vg1
Vg0
OUTSIDE REFERENCE RANGE
WITHIN REFERENCE RANGE
OUTSIDE REFERENCE RANGE

IMAGE FORMING APPARATUS FOR CONTROLLING PROCESSING CONDITIONS IN IMAGE FORMING PROCESS BY DETECTION OF TINER PATCH DENSITY FORMED ON PHOTORECEPTOR SURFACE

FIELD OF THE INVENTION

The present invention relates to a control for image stabilization in an image forming apparatus adopting the electrophotographic printing system, such as a copying machine, a laser printer, and a facsimile.

BACKGROUND OF THE INVENTION

An image forming apparatus for forming an image by the electrophotographic printing system includes such units as a photoreceptor, a charger, an exposing unit, and a developing unit. Because the properties of such units are changed in accordance with a change in environment and with time, the image forming condition of the image forming apparatus adopting the electrophotographic printing system is also changed in accordance with a change in environment such as temperature and humidity, and the total number of image formation. Thus, it is difficult to stably obtain a constant image forming condition.

In order to overcome this drawback, for the purpose of stabilizing the image by controlling image forming process conditions such as amount of charge, exposure amount, and development bias, a conventional image forming apparatus is provided with a variety of image stabilizing functions. Controlling of image forming process conditions is generally carried out at a predetermined timing when the power is turned on and when a predetermined number of copies have been made. For example, by changing the output of a static charger, a plurality of toner patch electrostatic latent images having different surface potentials are formed on the surface of a photoreceptor drum, and the toner patch electrostatic latent images are made visible into a plurality of toner patches having different toner density by supplying of developer from a developing unit, and the density of each toner patch made visible is detected by a photosensor. The charger output, which is an output of the static charger, which has produced a toner patch in the plurality of toner patches, whose detected density data coincide with reference data is used in the following copying processes.

Note that, since the number of toner patches formed is limited, it is not necessarily the case that the density of the toner patch in the plurality of toner patches coincides with the reference data. Thus, in the case where there is no detected density data coinciding with the reference data, detected density data P1 and P2 (P1<P<P2) close to the reference data are selected so as to determine the values of "a" and "b" in the following equations:

$$Vg\mathbf{1}=aP\mathbf{1}+b$$

$$Vg\mathbf{2}=aP\mathbf{2}+b$$

where Vg1 and Vg2 are charger outputs which have formed the toner patches of the detected density data P1 and P2, respectively. Then, the charger output Vg for obtaining the density of reference data P is determined using the following equation.

$$Vg=aP+b$$

Also, as another method for controlling the processing conditions based on the toner patch formed in the processing control, for example, Japanese Unexamined Patent Publication No. 51551/1994 (Tokukaihei 6-51551) discloses an arrangement wherein a toner patch is formed on a predetermined region on a photoreceptor, and image forming process conditions are corrected based on the difference in density of the toner patch and the non-image region.

Also, Japanese Unexamined Patent Publication No. 19259/1994 (Tokukaihei 6-19259) discloses an arrangement wherein in toner of the toner patch region formed on the photoreceptor, the amount of toner remaining on the photoreceptor after transferring process is detected, and the charge eliminating output is controlled in accordance with the transfer efficiency determined from the detected amount of toner.

Further, Japanese Unexamined Patent Publication No. 97665/1986 (Tokukaisho 61-97665) discloses an arrangement wherein a toner patch is formed on a photoreceptor before scanning the document from an image which has been positioned beforehand in a vicinity of a document table in a direction orthogonal to the moving direction of the photoreceptor (sheet transporting direction on the surface of photoreceptor), and the image forming process conditions are controlled individually with respect to plurality of positions orthogonal to the moving direction of the photoreceptor so as to uniformalize the density with respect to the entire image.

However, in the case where the document density is uneven in a direction orthogonal to the sheet transporting direction on the surface of the photoreceptor, the image density, the under fogging, the amount of toner consumed, and the contamination in the apparatus also become uneven, resulting in instable image quality and poor economy. Also, in the case where the number of image formation with respect to a sheet having a particular size is greater than that of a sheet having other sizes, large numbers of sheets contact with a certain range of the surface of the photoreceptor in a direction orthogonal to the sheet transporting direction, causing an uneven wear on the certain range of the photoreceptor. This results in differences in the charging ability and the sensitivity of the photoreceptor in a direction orthogonal to the sheet transporting direction on the surface of the photoreceptor, making the image density nonuniform. In this manner, under certain conditions, due to the fact that the surface of the photoreceptor is worn and deteriorated unevenly in a direction orthogonal to the sheet transporting direction, which has a large influence on image formation, uneven image forming conditions are generated to the degree which cannot be handled properly by the conventional image stabilizing methods, and as a result, an image with a nonuniform image quality is often generated.

SUMMARY OF THE INVENTION

It is an object of the present invention to provide an image forming apparatus capable of maintaining uniform image forming conditions with respect to the entire surface of a photoreceptor, even when the surface of the photoreceptor is worn and deteriorated unevenly in a direction orthogonal to a sheet transporting direction.

In order to achieve the above-mentioned object, an image forming apparatus in accordance with the present invention for forming a toner patch on a surface of a photoreceptor at a predetermined timing, and detecting density of the toner patch so as to control process conditions in an image forming process in an electrophotographic printing system includes controlling means for forming a toner patch on respective regions within and outside a reference range, in a direction orthogonal to a sheet transporting direction on the surface of the photoreceptor, which has been determined in accordance with a size of a sheet and frequency of the sheet used so as to carry out a control of process conditions in accordance with density of the toner patch with respect to the respective regions within and outside the reference range.

With this arrangement, processing conditions are individually controlled with respect to respective regions within and outside the reference range in a direction orthogonal to the sheet transporting direction of the photoreceptor. Note that, the reference range is determined, for example, based on the size of the sheet which is supplied in a largest number (most frequently used). Thus, in the case where the surface of the photoreceptor is worn and deteriorated unevenly in a direction orthogonal to the sheet transporting direction due to the fact that a sheet having a particular size is used frequently, processing conditions are controlled individually with respect to each region which is worn and deteriorated differently from one another.

The image forming apparatus in accordance with the present invention may have an arrangement wherein a main charger for forming an electrostatic latent image on the surface of the photoreceptor is provided, and the controlling means individually controls charger output of the main charger with respect to the respective regions within and outside the reference range in accordance with the result of detection of density of the toner patch of the respective regions within and outside the reference range.

With this arrangement, the charger output is individually controlled with respect to the respective regions within and outside the reference range in a direction orthogonal to the sheet transporting direction of the photoreceptor. Thus, the amount of charge on the surface of the photoreceptor, which affects the developer density, is controlled individually with respect to the plurality of regions in accordance with the wear and deterioration on the surface of the photoreceptor, and the developer density is maintained uniformly with respect to the entire surface of the photoreceptor.

The image forming apparatus in accordance with the present invention may have an arrangement wherein a transfer charger is provided, and the controlling means individually controls transfer efficiency with respect to the respective regions within and outside the reference range in accordance with the result of detection of density of the toner patch of the respective regions within and outside the reference range.

With this arrangement, the transfer efficiency is controlled individually with respect to the respective regions within and outside the reference range in a direction orthogonal to the sheet transporting direction of the photoreceptor. Thus, the transfer efficiency when a developer image is transferred onto the upper surface of the sheet from the surface of the photoreceptor is individually controlled with respect to the plurality of regions in accordance with the wear and deterioration on the surface of the photoreceptor, and the amount of developer transferred is uniformly maintained with respect to the entire surface of the sheet.

The image forming apparatus in accordance with the present invention may have an arrangement wherein exposing means is provided, and the controlling means individually controls an exposure amount for the respective regions within and outside the reference range in accordance with the result of detection of density of the toner patch of the respective regions within and outside the reference range.

With this arrangement, the exposure amount is controlled individually with respect to the respective regions within and outside the reference range in a direction orthogonal to the sheet transporting direction of the photoreceptor. Thus, the amount of exposing light, which affects the developer density on the surface of the photoreceptor, is individually controlled with respect to the plurality of regions in accordance with the wear and deterioration on the surface of the photoreceptor, and the developer density is maintained uniformly with respect to the entire surface of the photoreceptor.

The image forming apparatus in accordance with the present invention may have an arrangement wherein developer supplying means is provided for supplying developer to the photoreceptor, and the controlling means individually controls an amount of developer supplied with respect to the respective regions within and outside the reference range on the surface of the photoreceptor in accordance with the result of detection of density of the toner patch of respective regions within and outside the reference range.

With this arrangement, the amount of developer supplied is controlled individually with respect to respective regions within and outside the reference range in a direction orthogonal to the sheet transporting direction of the photoreceptor. Thus, the amount of developer supplied, which affects the developer density on the surface of the photoreceptor, is individually controlled with respect to the plurality of regions in accordance with the wear and deterioration on the surface of the photoreceptor, and the developer density is maintained uniformly with respect to the entire surface of the photoreceptor.

The image forming apparatus in accordance with the present invention may have an arrangement wherein charge eliminating means is provided for eliminating charge on the surface of the photoreceptor, and the controlling means individually controls charge eliminating efficiency with respect to the respective regions within and outside the reference range on the surface of the photoreceptor in accordance with the result of detection of density of the toner patch of the respective regions within and outside the reference range.

With this arrangement, the charge eliminating efficiency is individually controlled with respect to respective regions within and outside the reference range in a direction orthogonal to the sheet transporting direction on the surface of the photoreceptor. Thus, the charge eliminating efficiency, which affects the developer density on the surface of the photoreceptor, is individually controlled with respect to the plurality of regions in accordance with the wear and deterioration on the surface of the photoreceptor, and the developer density is maintained uniformly with respect to the entire surface of the photoreceptor.

For a fuller understanding of the nature and advantages of the invention, reference should be made to the ensuing detailed description taken in conjunction with the accompanying drawings.

BRIEF DESCRIPTION OF THE DRAWINGS

FIG. 2(A) through FIG. 2(D) are explanatory drawings showing a relationship between charger output and toner patch density in the image forming apparatus in accordance with First Embodiment; FIG. 2(A) shows toner patch density as formed by the charger output of FIG. 2(B) during processing control, and FIG. 2(C) shows toner patch density formed when the charger output is set to the charger output of FIG. 2(D) during processing control.

DESCRIPTION OF THE EMBODIMENTS

[First Embodiment]

Figure 1:
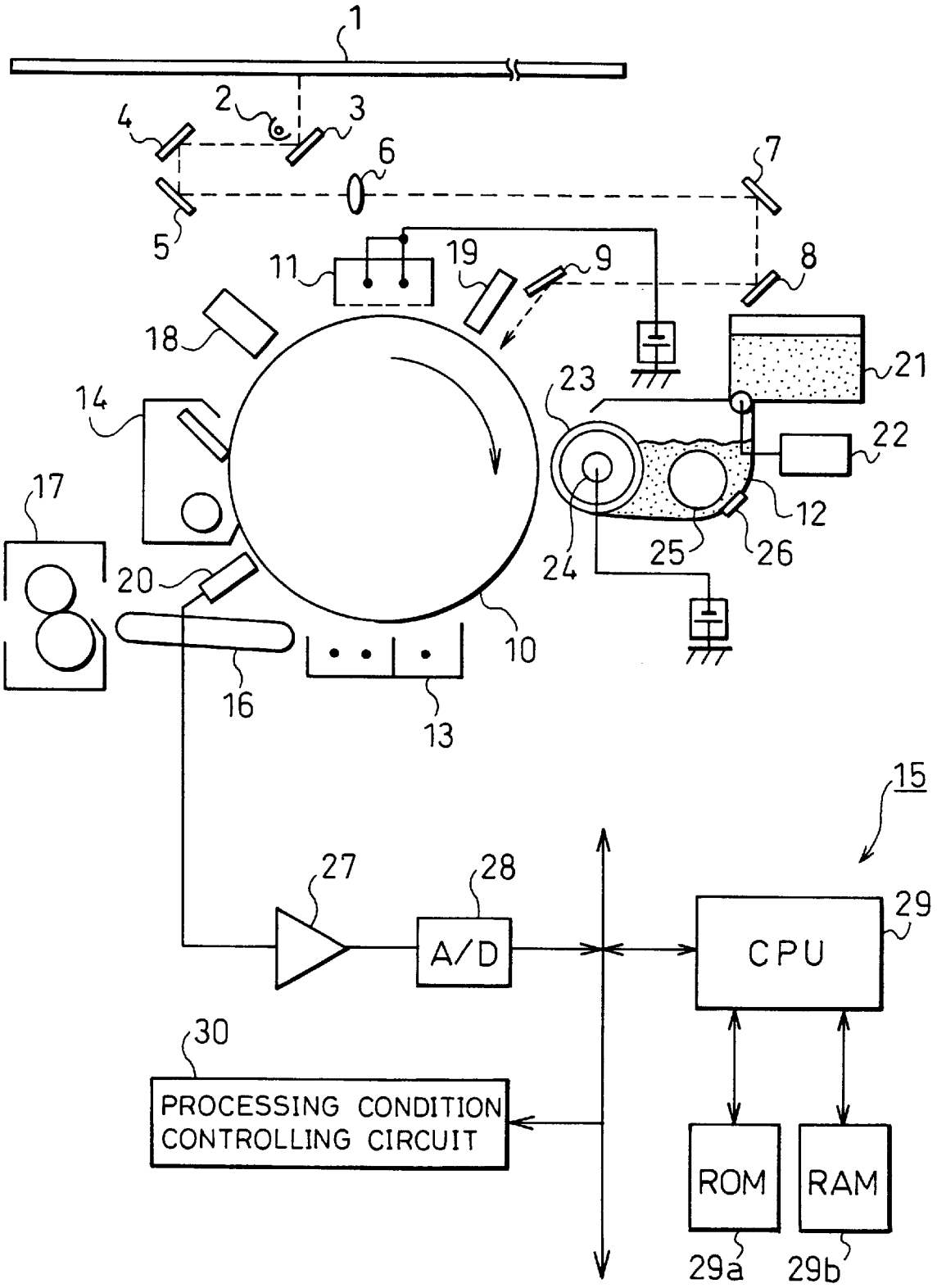
FIG. 1 is an explanatory drawing showing a schematic arrangement of an image forming apparatus in accordance with First Embodiment of the present invention.

FIG. 1 is an explanatory drawing schematically showing an image forming apparatus in accordance with one embodiment of the present invention. The upper surface of the image forming apparatus is provided with a document table 1, and on the side of the rear surface of the document table 1, there are provided a copy lamp 2, mirrors 3 through 5, a lens 6, and mirrors 7 through 9, constituting an optical system. The copy lamp 2 and the mirrors 3 through 5 are laterally moved back and forth along the rear surface of the document table 1 so as to scan the image of a document placed on the document table 1.

On substantially the central portion of the image forming apparatus, a photoreceptor drum 10 whose surface is made from a photoconductive material is rotatably provided. Around the photoreceptor drum 10, a main charger 11 for forming an electrostatic image on the surface of the photoreceptor drum 10, a developing unit 12, a transfer charger 13, a cleaner 14, a charge eliminating lamp 18, a blank lamp 19, and a photo sensor 20 are provided so as to face the surface of the photoreceptor drum 10. On a portion facing a spacing between the photoreceptor drum 10 and the transfer charger 13, there is provided a transporting belt 16 which transports a sheet discharged from the spacing to a fixing unit 17.

The photosensor 20 is connected to a CPU 29 constituting a control unit 15 via an amplifier 27 and an A/D converter 28. The detected signal from the photo sensor 20, after amplified to a predetermined level by the amplifier 27, is converted to digital data by the A/D converter 28, and is inputted to the CPU 29. The CPU 29 outputs, in accordance with the digital data, a processing condition controlling signal to a processing condition controlling circuit 30.

The image forming apparatus, when a document is placed on the document table 1 and a copy button (not shown) is operated, starts an image forming process. First, the copy lamp 2 and the mirrors 3 through 5 are laterally moved along the rear surface of the document table 1 so as to expose the image of a document placed on the document table 1. The reflected light off the surface of the document image is projected onto the surface of the photoreceptor drum 10 via the mirrors 3 through 5, the lens 6, and the mirrors 7 through 9. The surface of the photoreceptor drum 10 is uniformly charged beforehand with a unipolar charge by the main charger 11 prior to projection of the reflected light off the document. By the photoconductive effect due to projection of the reflected light off the document, a electrostatic latent image is formed on the surface of the photoreceptor drum 10. A developer is supplied from the developing unit 12 onto the surface of the photoreceptor drum 10 on which an electrostatic latent image has been formed, and the electrostatic latent image is made visible into a developer image.

A sheet is supplied from a sheet supplying section (not shown) in synchronization with the rotation of the photoreceptor drum 10, and between the photoreceptor drum 10 and the transfer charger 13, the front surface of the sheet is faced with the developer image held on the surface of the photoreceptor drum 10, and the developer image is transferred onto the front surface of the sheet by the corona discharge of the transfer charger 13. The sheet on which the developer image has been transferred is guided to the fixing unit 17 via the transporting belt 16 so as to be subjected to heat and pressure, and the developer image is melted and fixed onto the upper surface of the sheet. A portion on the surface of the photoreceptor drum 10, having passed through the portion facing the transfer charger 13, is subjected to the cleaner 14 which removes residual developer, and after residual charge is removed by the charge eliminating lamp 18, the surface of the photoreceptor drum 10 is charged again by the main charger 11, and the image forming process is repeated.

The developing unit 12 for supplying developer to the photoreceptor drum 10 is provided inside with a non-magnetic sleeve 23 and a stirring roller 25, and stores developer composed of toner and carrier. The toner and carrier constituting the developer are stirred by the stirring roller 25 so as to be charged by friction. The developer which has been charged by friction is transported onto the surface of the photoreceptor drum 10 by the rotation of the non-magnetic sleeve 23 covering a magnet 24, and only the toner is flown onto the electrostatic latent image formed on the surface of the photoreceptor drum 10. Thus, in the image forming process, only the toner in the developer stored in the developing unit 12 is consumed. The developing unit 12 is provided with a toner concentration detecting sensor 26 which detects the toner concentration of the developer in the developing unit 12, and a toner hopper 21 storing toner to be supplied to the developing unit 12. The results of detection by the toner concentration sensor 26 are compared with a toner concentration reference value which has been determined beforehand, and in accordance with the results of comparison, a toner supplying motor 22 is rotated as required so as to supply toner to the developing unit 12 from the toner hopper 21.

In the image forming apparatus in accordance with the present embodiment, (1) a system for forming a toner patch, (2) a system for detecting toner patch density, and (3) a system for controlling a charger output are provided independently for respective regions within and outside the reference range of a sheet width in a direction orthogonal to the sheet transporting direction, and a toner patch is formed individually for the respective regions within and outside the reference range, and the density is detected for each toner patch of the respective regions within and outside the reference range, and processing conditions such as a charger output are controlled through the processing condition controlling circuit 30 so that the density of the toner patches of the respective regions within and outside the reference range coincide with each other. The toner patch is formed, as in the conventional processing control, when the image forming apparatus is turned on, and at the timing when the total number of image formation coincides with a predetermined value.

FIG. 2(A) through FIG. 2(D) are explanatory drawings showing the relationship between charger output and toner patch density in the image forming apparatus in accordance with the present embodiment. FIG. 2(A) shows toner patch density formed by the charger output of FIG. 2(B) in the processing control, and FIG. 2(C) shows toner patch density formed when the charger output is set to the charger output of FIG. 2(D) in the processing control.

In the processing control, in respective regions within and outside the reference range on the surface of the photoreceptor drum 10, in the case where the toner patch density formed by a single charger output Vg0 is ID1 and ID2 (ID1>ID2), respectively (see FIG. 2(A) and FIG. 2(B)), by adjusting the charger output for regions outside the reference range, which is set in the main charger 11 through the processing condition controlling circuit 30 of the control unit 15, to Vg1 (Vg1>Vg0), the toner patch density ID1 within the reference range coincides with the toner patch density ID2 outside the reference range (see FIG. 2(C) and FIG. 2(D)).

Note that, the reference range is determined beforehand in accordance with the size of the sheet which is frequently used in the image forming apparatus. For example, in an image forming apparatus in which the position of the document placed and the position of the sheet transported are determined by using, as a reference, the center on the surface of the photoreceptor drum 10 in a direction orthogonal to the sheet transporting direction, when the sheet frequently used is of A4 size, the reference range is the range extending 148.5 mm in the both directions from the center. In an image forming apparatus in which the position of the document placed and the position of the sheet transported are determined by using, as a reference, one end on the surface of the photoreceptor drum 10 in a direction orthogonal to the sheet transporting direction, when the sheet frequently used is of A4 size, the reference range is the range extending 297 mm from the reference end.

Figure 3B:
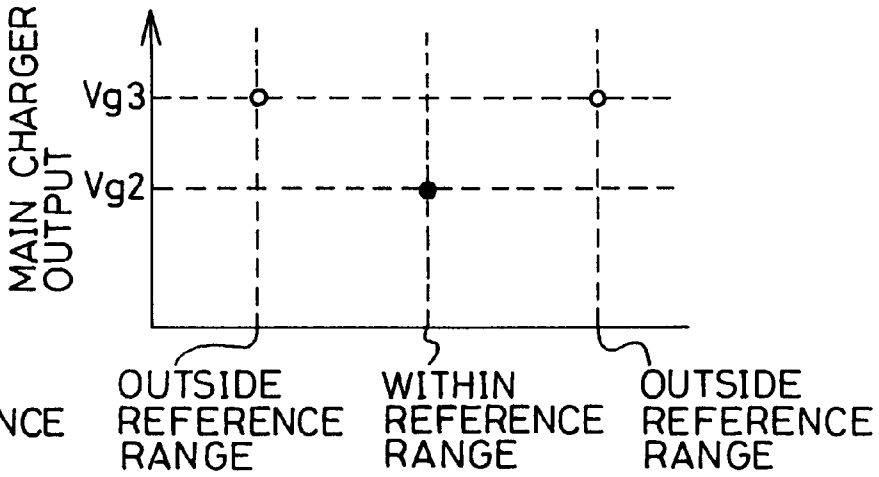
FIG. 3(A) and FIG. 3(B) are explanatory drawings showing how processing conditions are controlled in the image forming apparatus.
Figure 3A:
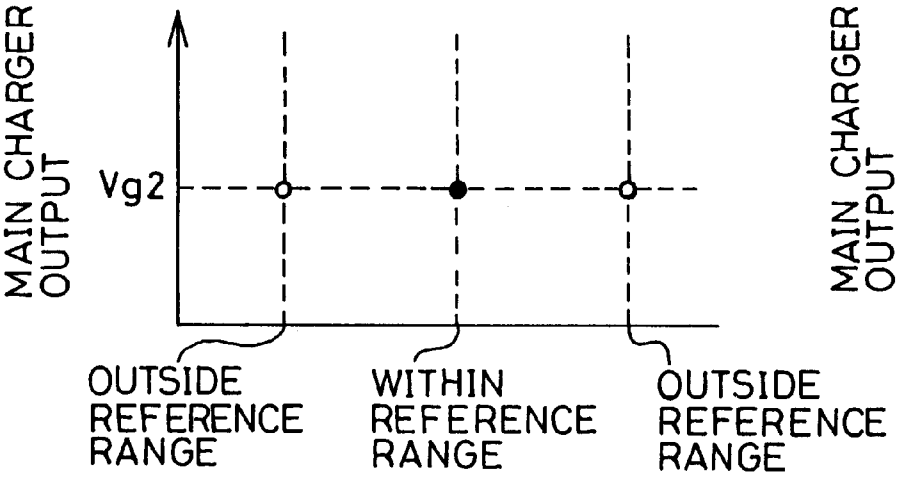

Also, in the same process as above, as shown in FIG. 3(A) and FIG. 3(B), by changing the charger output for regions outside the reference range of a sheet of B5 size from Vg2 to Vg3 (Vg3>Vg2) at the timing when half the number of copies are reached in a number of copies which is set beforehand in accordance with the life of the photoreceptor, and when the frequency of using the sheet of B5 size exceeds 60 percent, it is possible to obtain stable image forming conditions.

Figure 4:
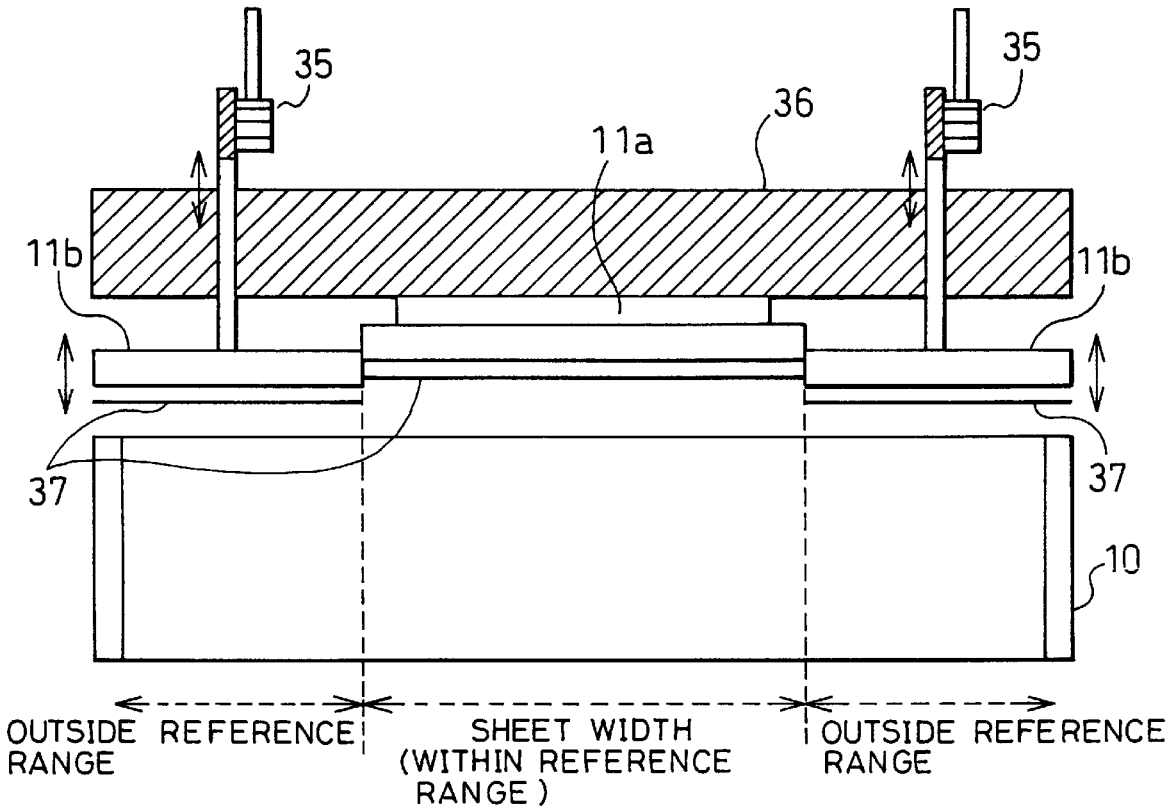
FIG. 4 is a cross sectional view showing an arrangement of a main charger provided in a modified image forming apparatus of First Embodiment.

The following explains a modified main charger 11 of the image forming apparatus of the present embodiment referring to FIG. 4. The modified main charger 11 is separated into a main charger 11*a* (first charger) and main chargers 11*b* (second chargers), the former being positioned within the reference range and the latter being positioned outside the reference range. Also, a supporting plate 36 (supporting means) is provided, facing the photoreceptor drum 10, and the main charger 11*a* is fixed to the supporting plate 36, and the main chargers 11*b* are supported by the supporting plate 36 so that the main chargers 11*b* are movable towards and away from the photoreceptor drum 10. Note that, the main chargers 11*b* are respectively moved in a direction towards and away from the photoreceptor drum 10 by moving mechanisms 35. The moving mechanisms 35 are driven by the processing condition controlling circuit 30 of the control unit 15.

Figure 5:
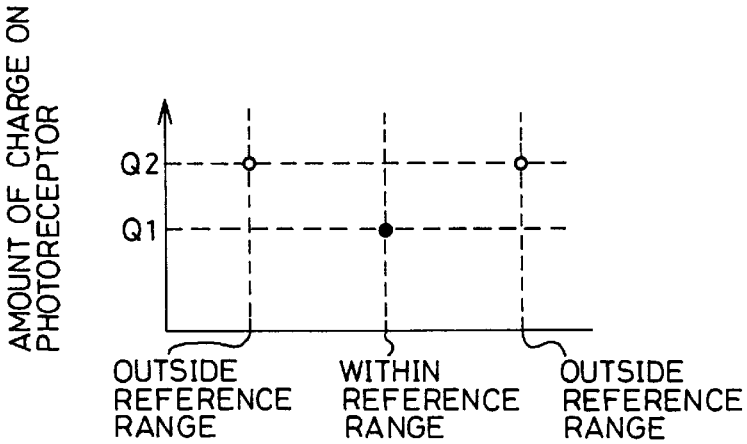
FIG. 5 is an explanatory drawing showing how processing conditions are controlled in the processing control of the modified image forming apparatus.

In the arrangement of the modified main charger 11, in the processing control, in the case where the toner patch density within the reference range becomes higher than the toner patch density outside the reference range, the processing condition controlling circuit 30 drives the moving mechanisms 35 so as to move the main chargers 11*b* outside the reference range towards the photoreceptor drum 10 by a predetermined amount. Consequently, as shown in FIG. 5, on the surface of the photoreceptor drum 10, the amount of charge Q2 outside the reference range is increased higher than the amount of charge Q1 within the reference range. As a result, the toner density is made uniform with respect to the entire surface of the photoreceptor drum 10.

Note that, the described effect can be obtained not only in the main charger 11 of the scorotron type provided with a grid 37 as shown in FIG. 4 but also in a main charger of the corotron type not provided with the grid.

Figure 6:
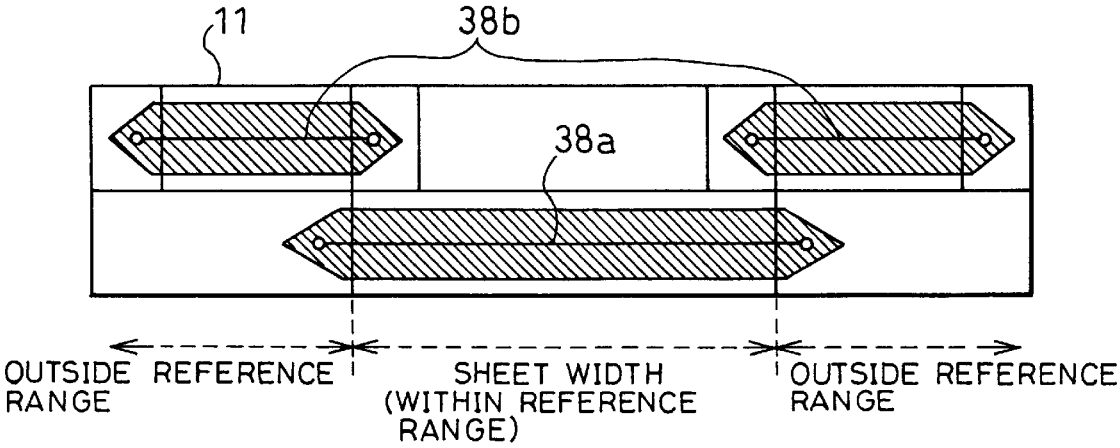
FIG. 6 is a plan view showing an arrangement of a main charger provided in an image forming apparatus in accordance with Second Embodiment of the present invention.

FIG. 6 is a drawing explaining another modified main charger 11. In this modification, in addition to a charger line (first charger line) 38*a* positioned within the reference range, the main charger 11 is also provided with charger lines (second charger lines) 38*b* positioned outside the reference range. The charger lines 38*a* and 38*b* are separately driven by the processing condition controlling circuit 30 of the control unit 15.

Figure 7:
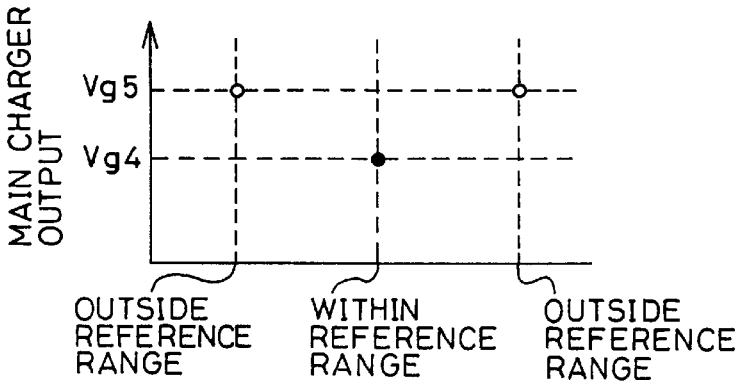
FIG. 7 is an explanatory drawing showing how processing conditions are controlled in the processing control of the image forming apparatus in accordance with Second Embodiment.

With this arrangement, in the processing control, in the case where the toner patch density within the reference range becomes higher than the toner patch density outside the reference range, as shown in FIG. 7, it is possible to increase an applied voltage Vg5 with respect to the charger lines 38*b* outside the reference range relatively higher than an applied voltage Vg4 with respect to the charger line 38*a* within the reference range. As a result, the toner density is made uniform with respect to the entire surface of the photoreceptor drum 10.

Note that, it is possible to adopt an arrangement wherein a main charger line is provided so as to face the photoreceptor drum 10 with respect to the entire width (within and outside the reference range) in a direction orthogonal to the sheet transporting direction, and sub charger lines are provided so as to face only the regions outside the reference range of the photoreceptor drum 10, wherein while under a normal condition, a charging voltage is applied only to the main charger line, in the case where the toner patch density within the reference range becomes higher than the toner patch density outside the reference range in the processing control, the charging voltage is applied to both the main charger line and the sub charger lines. With this arrangement, the toner density is made uniform with respect to the entire surface of the photoreceptor drum 10.

[Second Embodiment]

Figure 8:
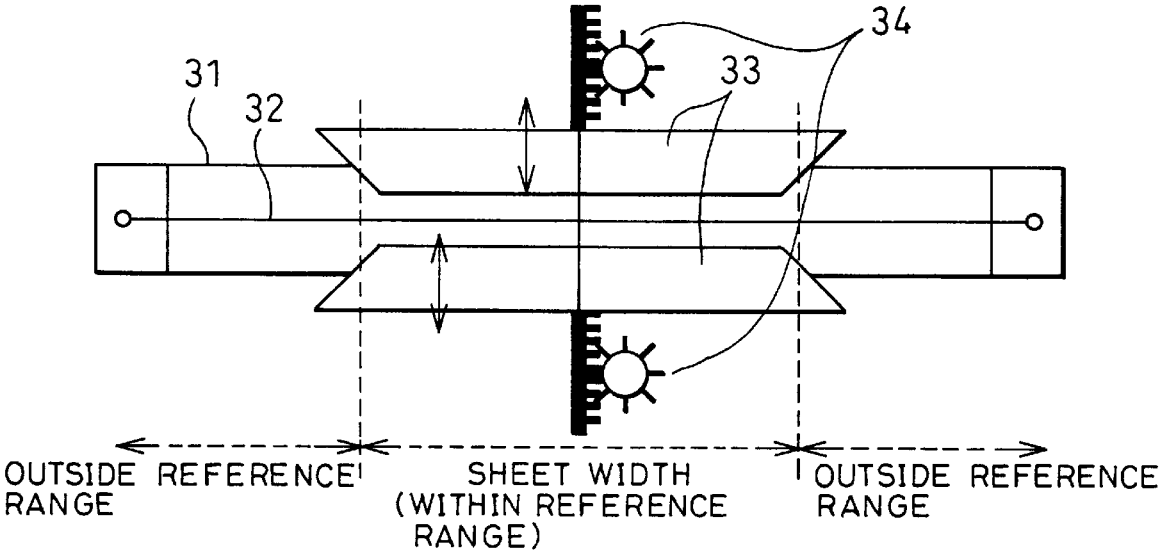
FIG. 8 is an explanatory drawing showing an arrangement of a transfer charger provided in a modified image forming apparatus in accordance with Second Embodiment.

FIG. 8 shows an arrangement of a transfer charger 31 provided in an image forming apparatus in accordance with Second Embodiment of the present invention. In the image forming apparatus of the present embodiment, on a surface of the transfer charger 31 facing the photoreceptor drum 10, there are provided two shutters 33, made of non-conductive resin, respectively having a length coinciding with the reference range, sandwitching a charger line 32. Also, moving mechanisms 34 for moving the shutters 33 towards and away from one another are provided. The moving mechanisms 34 are driven through the processing condition controlling circuit 30 of the control unit 15. With this arrangement, by driving the moving mechanisms 34 so as to move the shutters 33 towards and away from one another, it is possible to reduce or widen the opening area for the charger line 32 within the reference range, and change the transfer efficiency Tr of the transfer charger 31.

In the present embodiment, in the case where the patch density ID1 within the reference range becomes higher than the toner density ID2 outside the reference range, the moving mechanisms 34 are driven so as to move the shutters 33 towards one another. This reduces the transfer efficiency Tr1 of the transfer charger 31 within the reference range lower than the transfer efficiency Tr2 of the transfer charger outside the reference range. This allows the density of an image formed on a sheet having a size which is larger than the reference range to be uniformly formed with respect to the entire surface of the sheet.

Figure 9:
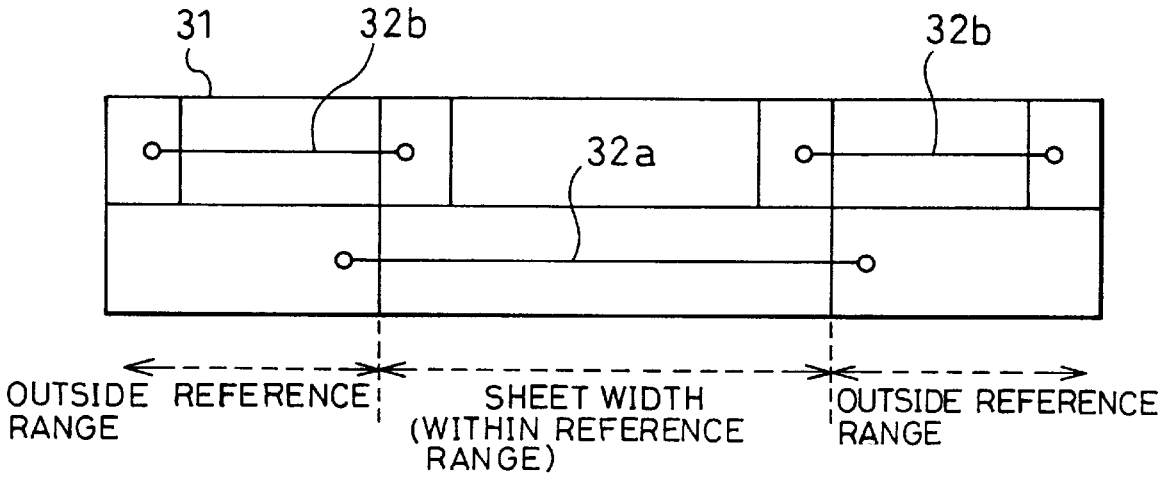
FIG. 9 is an explanatory drawing showing an arrangement of a transfer charger provided in another modified image forming apparatus in accordance with Second Embodiment.

FIG. 9 shows an arrangement of a modified transfer charger 31 of the image forming apparatus in accordance with the present embodiment. In this arrangement, in addition to a charger line 32*a* within the reference range, the transfer charger 31 is also provided with charger lines 32*b* outside the reference range, and the charger lines 32*a* and 32*b* are driven independently.

Figure 10:
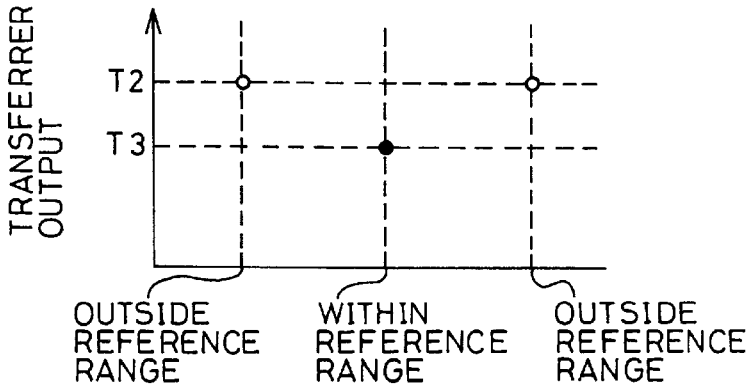
FIG. 10 is an explanatory drawing showing how processing conditions are controlled in the processing control of the image forming apparatus provided with the transfer charger of FIG. 9.

With this arrangement, in the processing control, in the case when the toner patch density within the reference range becomes higher than the toner patch density outside the reference range, as shown in FIG. 10, it is possible to reduce, through the processing condition controlling circuit 30 of the control unit 15, the transferrer output T3 of the charger line 32*a* within the reference range relatively lower than the transferrer output T2 of the charger lines 32*b* outside the reference range. This reduces the amount of toner transferred onto the sheet within the reference range lower than the amount of toner transferred onto the sheet outside the reference range. As a result, it is possible to uniformalize the density of the entire image when forming an image on a sheet larger than the reference range.

Figure 11:
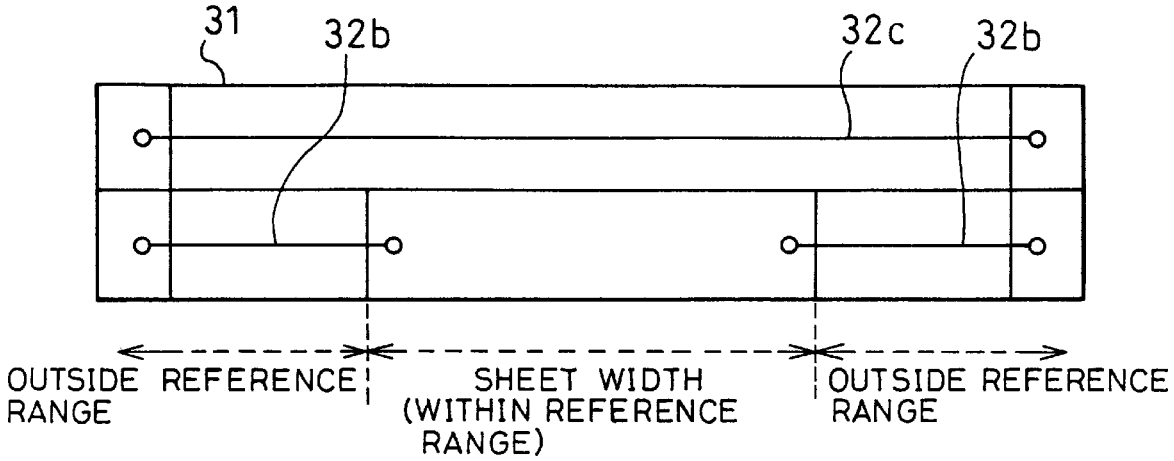
FIG. 11 is a plan view showing an arrangement of a transfer charger provided in still another modified image forming apparatus in accordance with Second Embodiment.

Note that, as another modification of the transfer charger 31, as shown in FIG. 11, it is possible to adopt an arrangement wherein the transfer charger 31 is provided with a charger line 32*c* facing the entire width in a direction orthogonal to the transporting direction and charger lines 32*b* positioned on regions outside the reference range, and the charger lines 32*c* and 32*b* are driven independently. With this arrangement, in the processing control, in the case where the toner patch density within the reference range becomes higher than the toner patch density outside the reference range, it is also possible to increase the transfer efficiency outside the reference range higher than the transfer efficiency within the reference range by applying a predetermined voltage to the charger line 32*c* within the reference range and to the charger lines 32*b* outside the reference range.

[Third Embodiment]

Figure 12:
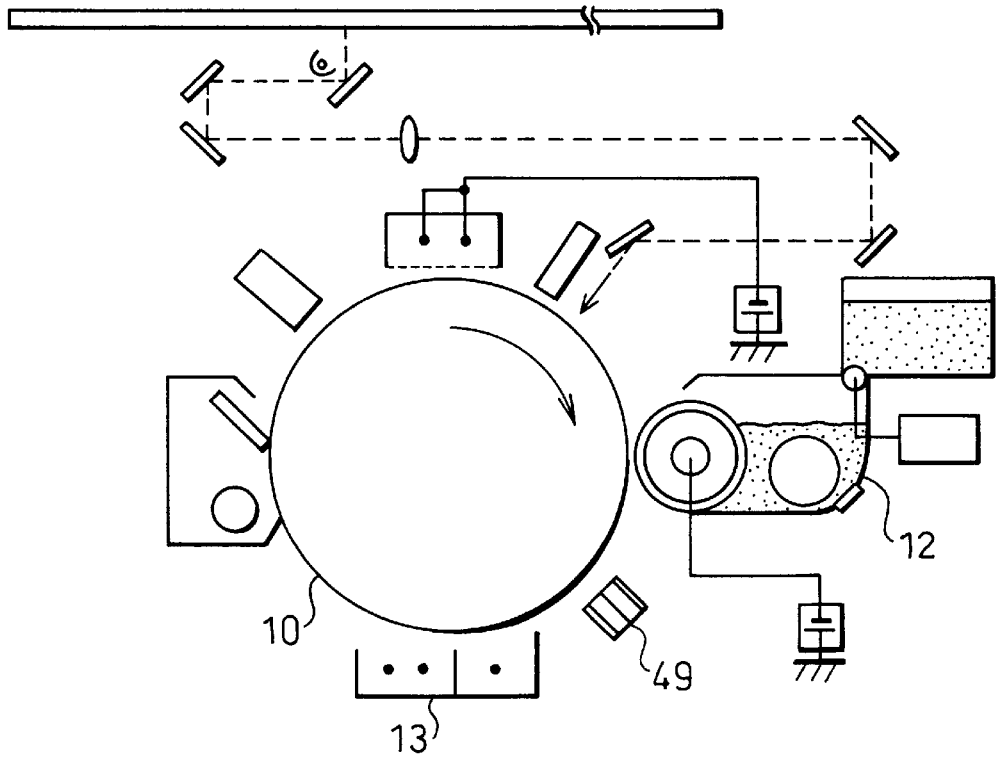
FIG. 12 is an explanatory drawing showing an arrangement of an image forming apparatus in accordance with Third Embodiment of the present invention.

FIG. 12 shows yet another embodiment of the image forming apparatus in accordance with the present invention. In the image forming apparatus of the present embodiment, between the developing unit 12 and the transfer charger 13, on a portion facing a portion on the surface of the photoreceptor drum 10 outside the reference range, there is provided a pre-transfer charger 49 for carrying out corona discharge of a charge having an opposite polarity to the main charger 11. When the pre-transfer charger 49 is driven in the image forming process, a charge having an opposite polarity to the charge holding the developer image on the surface of the photoreceptor drum 10 is applied onto the surface of the photoreceptor drum 10 by the corona discharge, and the force holding the developer image is weakened. As a result, the transfer efficiency of the transfer charger 13 is increased. The pre-transfer charger 49 is driven through the processing condition controlling circuit 30 of the control unit 15.

With this arrangement, in the processing control, in the case where the toner patch density within the reference range becomes higher than the toner patch density outside the reference range, in the following processes, the pre-transfer charger 49 is driven so as to reduce the force holding the developer image on a portion on the surface of the photoreceptor drum 10 outside the reference range, thus uniformalizing the image density with respect to the entire surface of a sheet larger than the reference range.

[Fourth Embodiment]

Figure 13:
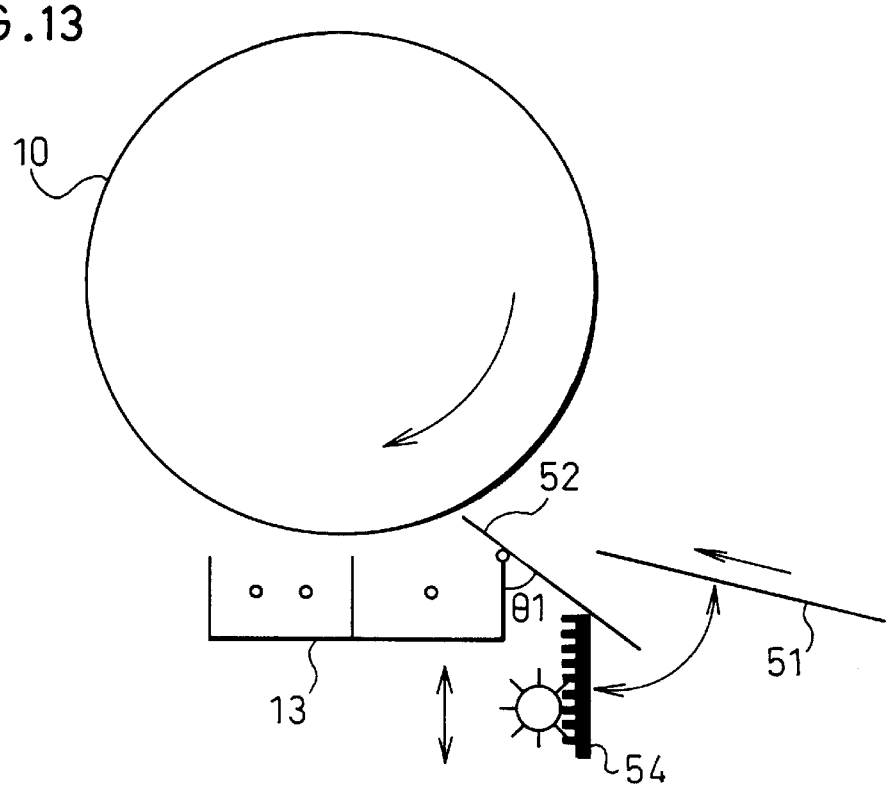
FIG. 13 is an explanatory drawing showing an arrangement of a sheet supplying section of an image forming apparatus in accordance with Fourth Embodiment of the present invention.

FIG. 13 is a drawing showing an arrangement of a sheet supplying section of an image forming apparatus of still another embodiment of the present invention. The image forming apparatus of the present embodiment is provided with a sheet supplying guide 52 which is rotatably supported for guiding a sheet to a spacing between the photoreceptor drum 10 and the transfer charger 13. The image forming apparatus of the present embodiment is further provided with a rotating mechanism 54 for changing the angle θ made by the sheet supplying guide 52 and a line perpendicular to the ground. The rotating mechanism 54 is driven through the processing condition controlling circuit 30 of the control unit 15.

With this arrangement, in the case where the toner patch density within the reference range becomes higher than the toner patch density outside the reference range, in the following processes, by the control of the processing condition controlling circuit 30, the rotating mechanism 54 is driven so as to increase the angle θ made by the sheet supplying guide 52 and a line perpendicular to the ground. This makes the slope of the sheet supplying angle with respect to the photoreceptor drum 10 gradual, and therefore reduces the overall transfer efficiency with respect to the entire surface of the sheet. As a result, a change in image density due to the edge effect at the borders of regions within and outside the reference range is reduced, thus reducing the density nonuniformity of the image formed on the sheet.

[Fifth Embodiment]

Figure 14:
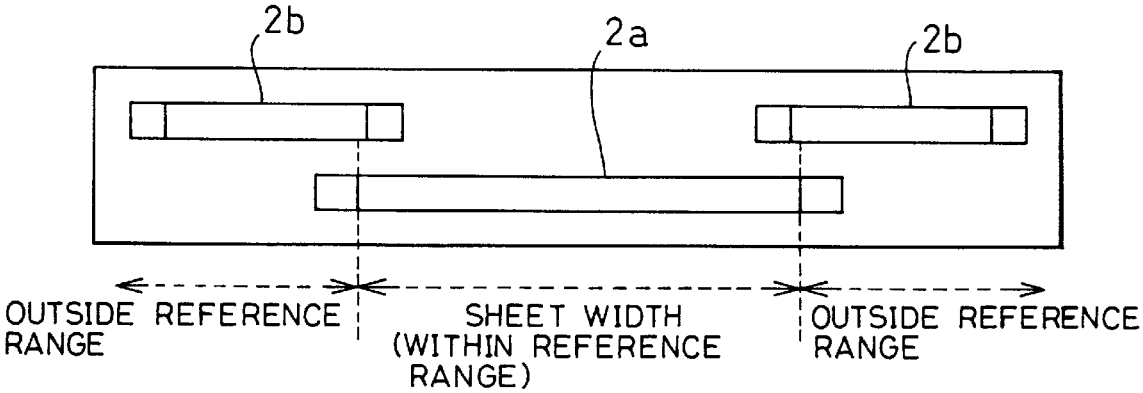
FIG. 14 is an explanatory drawing showing an arrangement of a copy lamp provided in an image forming apparatus in accordance with Fifth Embodiment of the present invention.

FIG. 14 is a drawing showing an arrangement of a copy lamp (exposing means) provided in an image forming apparatus in accordance with yet another embodiment of the present invention. The image forming apparatus of the present embodiment is provided with a copy lamp 2*a* (first light source) facing an image on the document surface within the reference range and copy lamps 2*b* (second light sources) facing the image on the document surface outside the reference range. The copy lamps 2*a* and 2*b* are driven independently.

Figure 15:
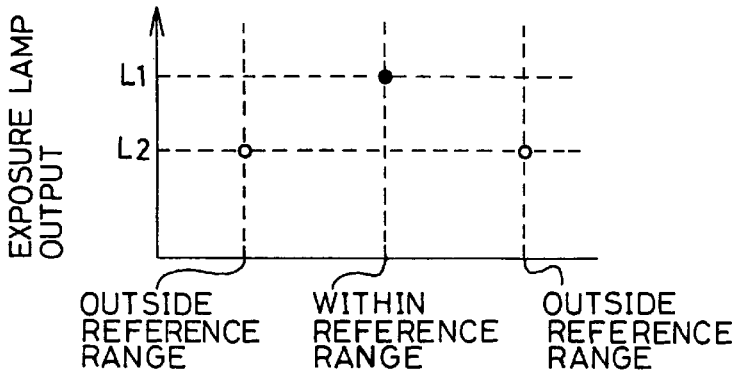
FIG. 15 is an explanatory drawing showing how processing conditions are controlled in the processing control of the image forming apparatus in accordance with Fifth Embodiment of the present invention.

With this arrangement, in the processing control, in the case where the toner patch density within the reference range becomes higher than the toner patch density outside the reference range, through the processing condition controlling circuit 30 of the control unit 15, as shown in FIG. 15, the output L1 of the copy lamp 2*a* within the reference range is increased relatively higher than the output L2 of the copy lamps 2*b* outside the reference range. This uniformalize the toner density with respect to the entire surface of the photoreceptor drum 10.

Figure 16:
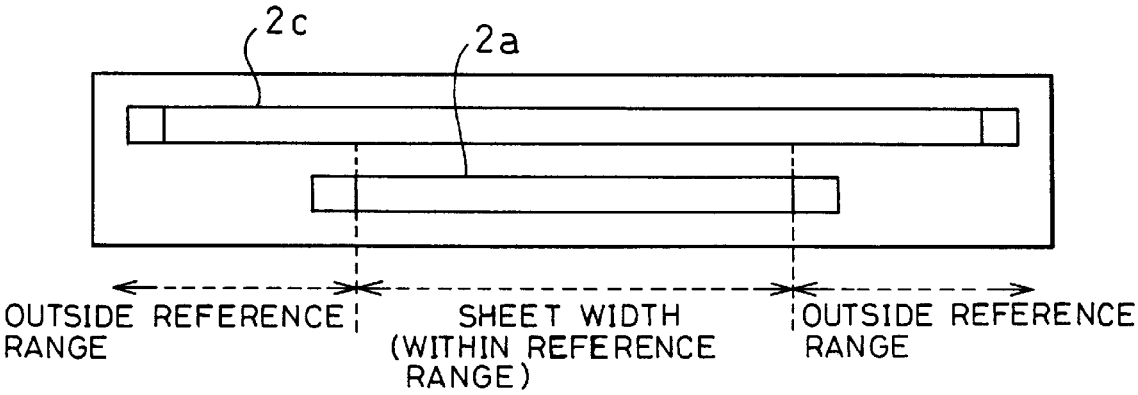
FIG. 16 is a drawing showing an arrangement of a copy lamp provided in a modified image forming apparatus in accordance with Fifth Embodiment of the present invention.

FIG. 16 is a drawing showing an arrangement of a modified copy lamp provided in the image forming apparatus in accordance with the present embodiment. The modified copy lamp includes a main copy lamp 2*c* facing an image on the document surface with respect to the entire range in a direction orthogonal to the sheet transporting direction and a sub copy lamp 2*a* facing the image on the document surface within the reference range. The sub copy lamp 2*a* and the main copy lamp 2*c* are driven independently through the processing condition controlling circuit 30 of the control unit 15.

Figure 17:
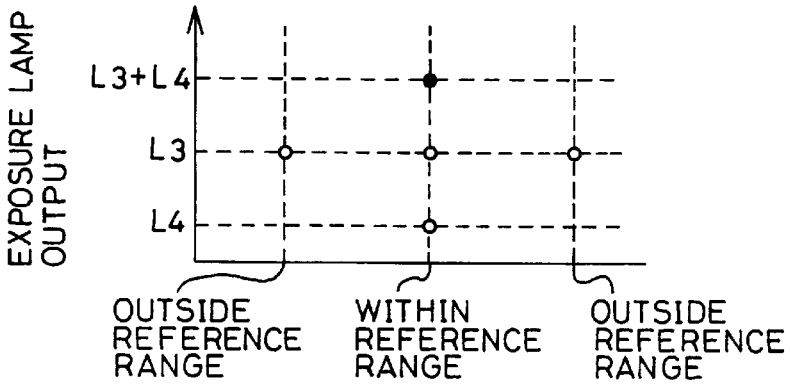
FIG. 17 is an explanatory drawing showing how processing conditions are controlled in the processing control of the image forming apparatus provided with the copy lamp of FIG. 16.

With this arrangement, in the processing control, in the case where the toner patch density within the reference range becomes higher than the toner patch density outside the reference range, as shown in FIG. 17, both the main copy lamp 2*c* and the sub copy lamp 2*a* are lit so that the output of the copy lamp within the reference range of the surface of the document image is the sum of the output L3 of the main copy lamp 2*c* and the output L4 of the sub copy lamp 2*a*. As a result, the amount of projected light within the reference range becomes larger than the amount of projected light outside the reference range, thus uniformalizing the toner density with respect to the entire surface of the photoreceptor drum 10.

[Sixth Embodiment]

Figure 18:
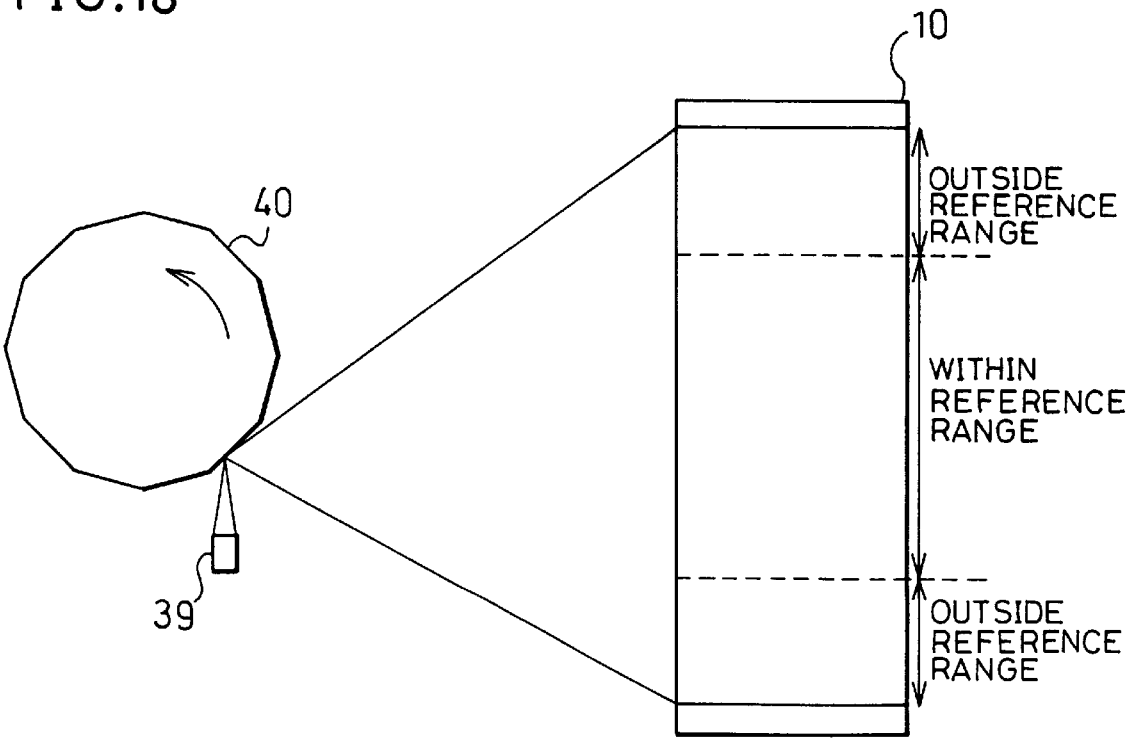
FIG. 18 is an explanatory drawing showing an arrangement of an exposing section provided in an image forming apparatus in accordance with Sixth Embodiment of the present invention.

FIG. 18 is a drawing showing an arrangement of an exposing section (exposing means) provided in an image forming apparatus of still another embodiment in accordance with the present invention. In an image forming apparatus such as a laser printer, a ray of laser 39 (laser light source), which is driven in accordance with the image data, is allowed scan the surface of the photoreceptor drum 10 in a direction orthogonal to the sheet transporting direction by a polygon mirror 40 so as to form an electrostatic latent image on the surface of the photoreceptor drum 10.

Figure 19:
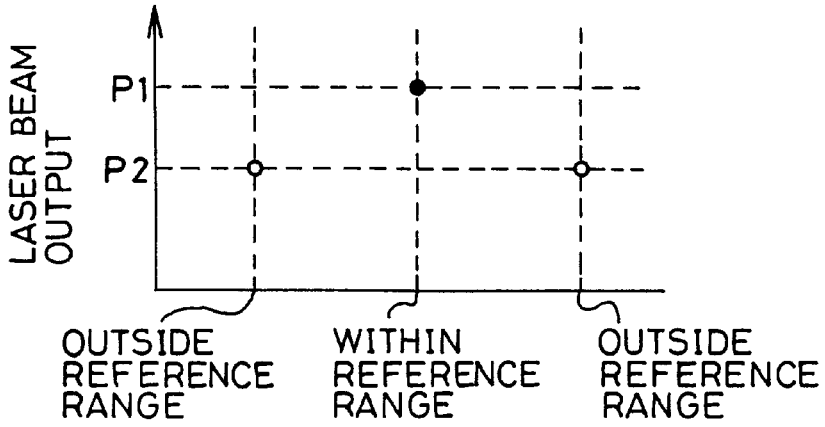
FIG. 19 is an explanatory drawing showing how processing conditions are controlled in the processing control of the image forming apparatus in accordance with Sixth Embodiment of the present invention.

In the image forming apparatus having this arrangement, in the processing control, in the case where the toner patch density within the reference range becomes higher than the toner patch density outside the reference range, as shown in FIG. 19, the laser beam output P1 from the laser 39 projected onto the region within the reference range on the surface of the photoreceptor drum 10 is increased relatively higher than the laser beam output P2 projected onto the region outside the reference range, thus uniformalizing the toner density with respect to the entire surface of the photoreceptor drum 10.

[Seventh Embodiment]

Figure 20:
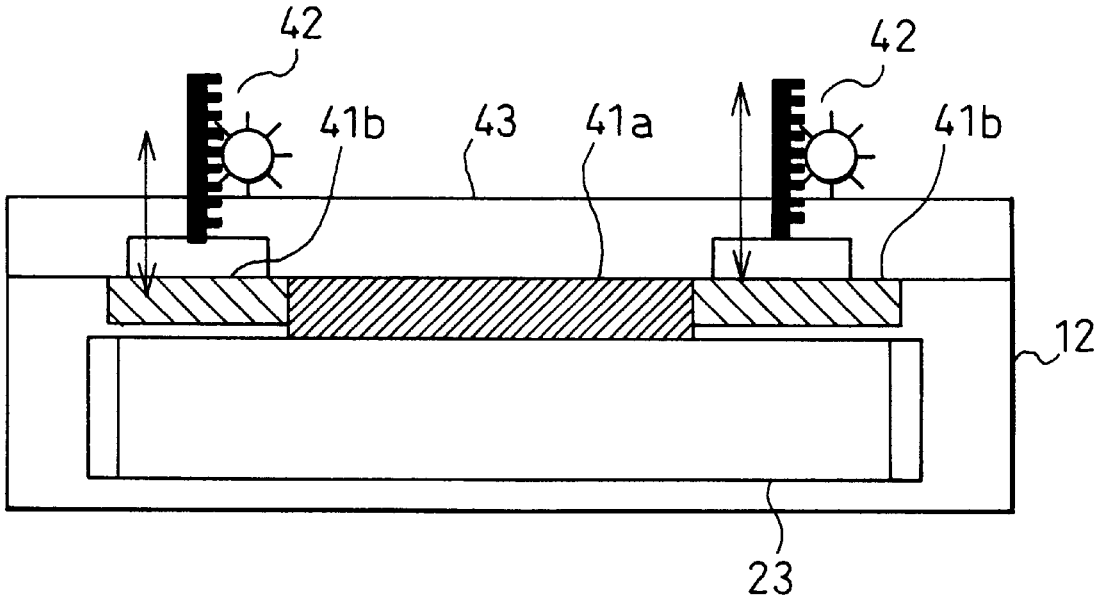
FIG. 20 is a cross sectional view showing main components of a developing unit provided in an image forming apparatus in accordance with Seventh Embodiment of the present invention.

FIG. 20 is a drawing showing an arrangement of main components of an developing unit 12 (developer supplying means) provided in an image forming apparatus in accordance with yet another embodiment of the present invention. The developing unit 12 of the image forming apparatus in accordance with the present embodiment has an arrangement wherein a doctor 41 for regulating the amount of developer to be adhered onto the surface of a development sleeve 23 is composed of a doctor 41*a* (first doctor) facing a region within the reference range on the surface of the development sleeve 23 and doctors 41*b* (second doctors) facing regions outside the reference range on the surface of the development sleeve 23.

The image forming apparatus of the present embodiment is also provided with a supporting plate 43 (supporting means) facing the development sleeve 23. The doctor 41*a* is fixed to the supporting plate 43, and the doctors 41*b* are supported by the supporting plate 43 so that the doctor 41*b* is movable towards or away from the development sleeve 23. The supporting plate 43 is provided with moving mechanisms 42 for moving the doctors 41*b* towards or away from the development sleeve 23. The moving mechanisms 42 are driven through the processing condition controlling circuit 30 of the control unit 15.

Figure 21:
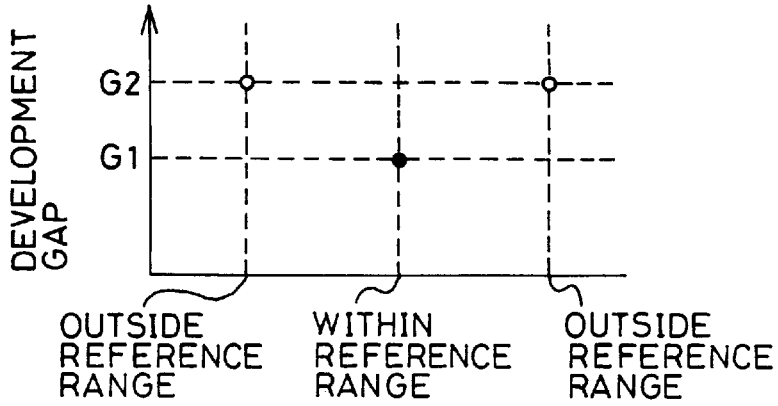
FIG. 21 is an explanatory drawing showing how processing conditions are controlled in the processing control of the image forming apparatus in accordance with Seventh Embodiment of the present invention.

With this arrangement, in the processing control, in the case where the toner patch density within the reference range becomes higher than the toner patch density outside the reference range, the moving mechanisms 42 are moved so as to move the doctors 41*b* away from the development sleeve 23. As a result, as shown in FIG. 21, it is possible to increase the development gap G2 outside the reference range relatively larger than the development gap G1 within the reference range, thus uniformalizing the toner density with respect to the entire surface of the photoreceptor drum 10.

[Eighth Embodiment]

Figure 22:
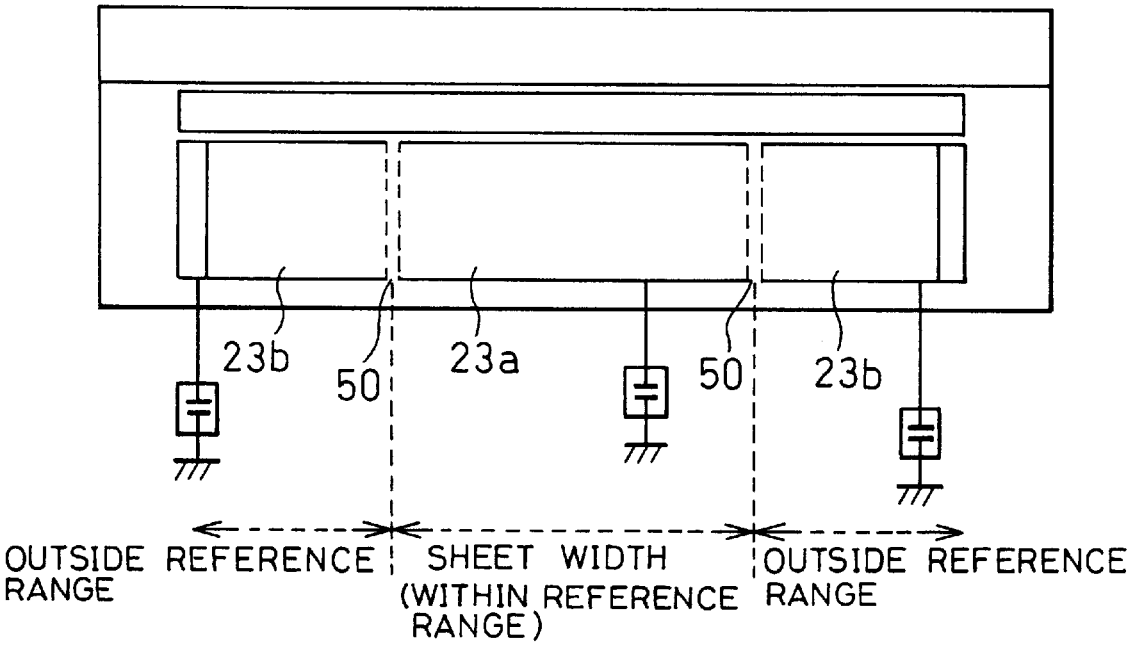
FIG. 22 is an explanatory drawing showing a development sleeve provided in an image forming apparatus in accordance with Eighth Embodiment of the present invention.

FIG. 22 is a drawing showing an arrangement of a development sleeve provided in an image forming apparatus in accordance with still another embodiment of the present invention. The image forming apparatus in accordance with the present embodiment has an arrangement wherein the surface of the development sleeve 23 is divided into three regions of a within-reference-range region 23*a* (first region) on the center and outside-reference-range regions 23*b* (second regions) on the both sides of the within-reference-range region 23*a*.

The within-reference-range region 23*a* and the outside-reference-range regions 23*b* are connected to each other by non-conductive materials 50, and a development bias is individually applied to the within-reference-range region 23*a* and the outside-reference-range regions 23*b* through the processing condition controlling circuit 30 of the control unit 15.

Figure 23:
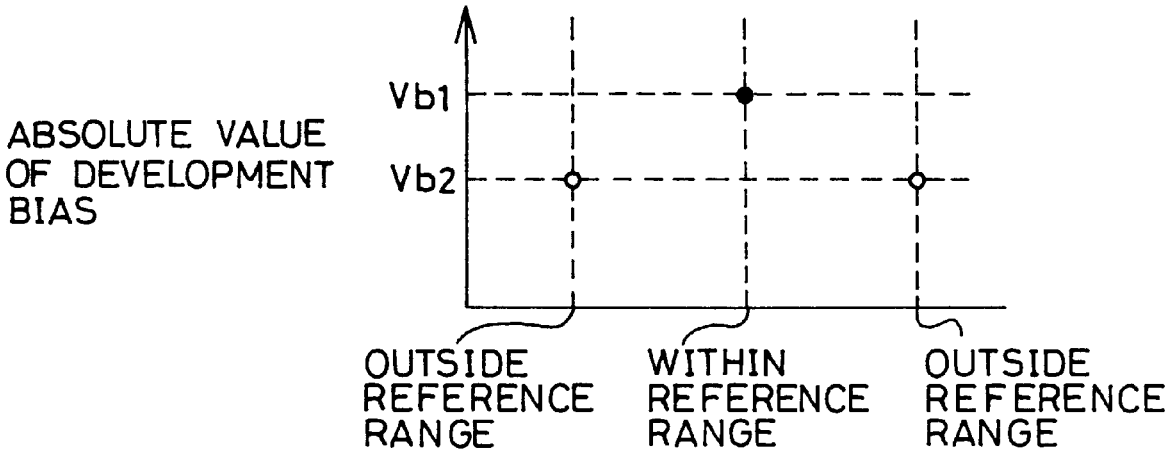
FIG. 23 is an explanatory drawing showing how processing conditions are controlled in the processing control of the image forming apparatus in accordance with Eighth Embodiment of the present invention.

With this arrangement, in the case where the toner patch density within the reference range becomes higher than the toner patch density outside the reference range, in the following image forming processes, as shown in FIG. 23, the absolute value of the development bias Vb1 applied to the within-reference-range region 23*a* of the development sleeve 23 is increased higher than the absolute value of the development bias Vb2 applied to the outside-reference-range regions 23*b*. As a result, it is possible to reduce the amount of developer adhered to the region within the reference range on the surface of the development sleeve 23 lower than the amount of developer adhered to the regions outside the reference range, thus uniformalizing the toner density with respect to the entire surface of the photoreceptor drum 10.

[Ninth Embodiment]

Figure 24:
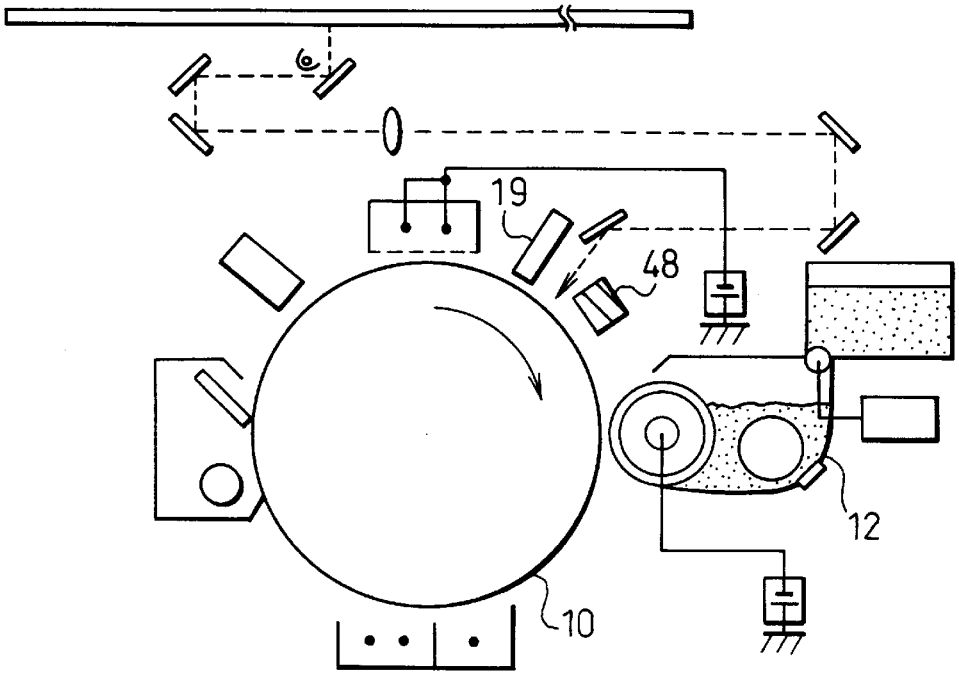
FIG. 24 is a cross sectional view showing an arrangement of an image forming apparatus in accordance with Ninth Embodiment of the present invention.

FIG. 24 is a drawing showing an arrangement of an image forming apparatus in accordance with yet another embodiment of the present invention. The image forming apparatus in accordance with the present embodiment is provided with an exposure charge eliminating lamp 48 (charge eliminating means and light source), between the blank lamp 19 and the development unit 12, facing the regions outside the reference range on the surface of the photoreceptor drum 10. When the exposure charge eliminating lamp 48 is lit in the image forming process, the charge on the surface of the photoreceptor drum 10 is reduced by the photoconductive effect. The exposure charge eliminating lamp 48 is driven through the processing condition controlling circuit 30 of the control unit 15.

With this arrangement, in the case where the toner patch density within the reference range becomes higher than the toner patch density outside the reference range, in the following image forming processes, the exposure charge eliminating lamp 48 is lit so as to reduce the charge outside the reference range on the surface of the photoreceptor drum 10, thus uniformalizing the toner density with respect to the entire surface of the photoreceptor drum 10.

Figure 25:
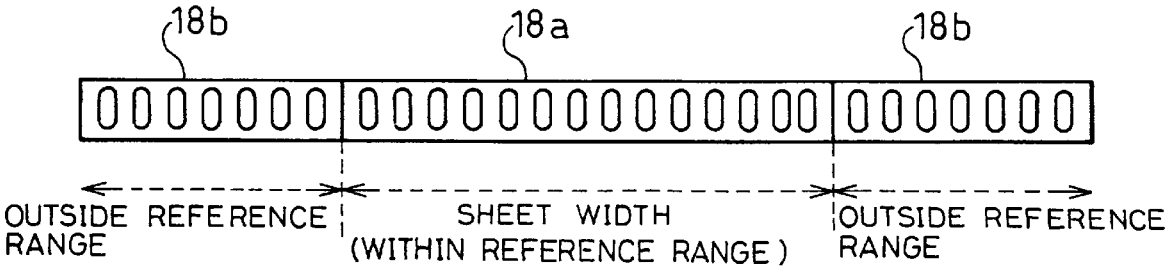
FIG. 25 is a plan view showing a modified charge eliminating lamp provided in the image forming apparatus in accordance with Ninth Embodiment.

FIG. 25 is a drawing showing a modified charge eliminating lamp provided in the image forming apparatus in accordance with the present embodiment. In this modified charge eliminating lamp, the charge eliminating lamp 18 is divided into three regions of a charge eliminating lamp 18*a* (first light source) facing the region within the reference range on the photoreceptor drum 10 and charge eliminating lamps 18*b* (second light sources), on the both sides of the charge eliminating lamp 18*a*, facing the regions outside the reference range. A charge eliminating voltage is individually applied to the charge eliminating lamp 18*a* and the charge eliminating lamps 18*b* through the processing condition controlling circuit 30 of the control unit 15.

Figure 26:
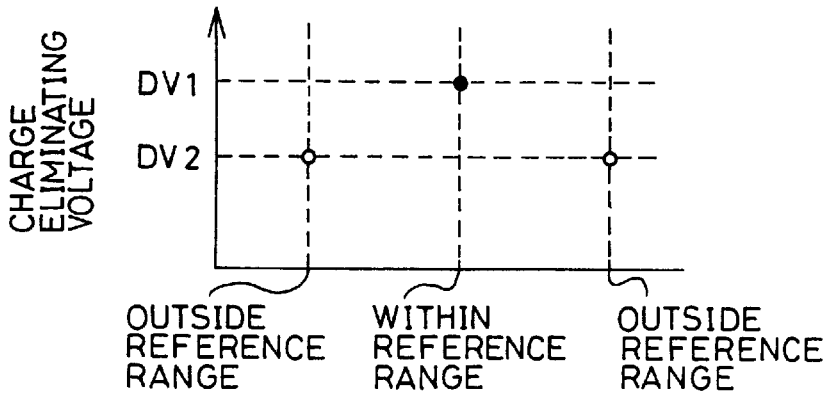
FIG. 26 is an explanatory drawing showing how processing conditions are controlled in the processing control of the image forming apparatus in accordance with Ninth Embodiment of the present invention.

With this arrangement, in the case where the toner patch density within the reference range becomes higher than the toner patch density outside the reference range, in the following image forming processes, as shown in FIG. 26, the charge eliminating voltage DV1 applied to the charge eliminating lamp 18*a* within the reference range is increased higher than the charge eliminating voltage DV2 applied to the charge eliminating lamps 18*b* outside the reference range. As a result, the charge potential of the region within the reference range on the surface of the photoreceptor drum 10 is reduced lower than the charge potential of the regions outside the reference range, thus uniformalizing the toner density with respect to the entire surface of the photoreceptor drum 10.

[Tenth Embodiment]

Figure 27:
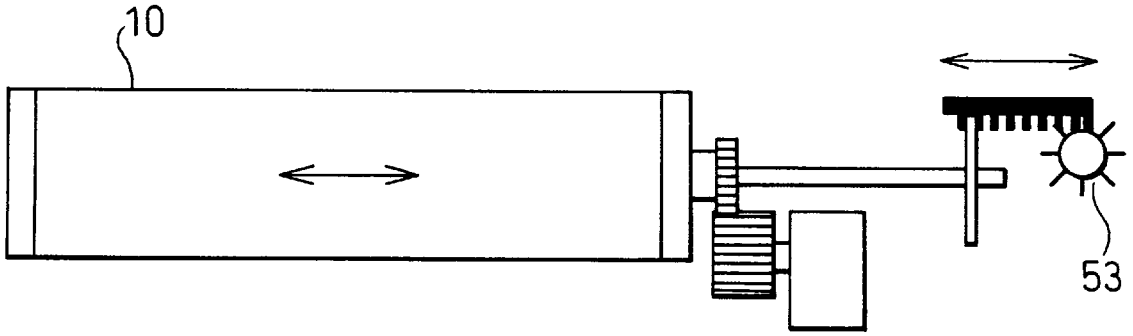
FIG. 27 is an explanatory drawing showing an arrangement of a photoreceptor drum provided in an image forming apparatus in accordance with Tenth Embodiment of the present invention.

FIG. 27 is a drawing showing an arrangement of an image forming apparatus in accordance with yet another embodiment of the present invention. As shown in FIG. 27, the image forming apparatus in accordance with the present embodiment has an arrangement wherein the photoreceptor drum 10 is supported so as to be movable for a predetermined amount back and forth in the axis direction, and a moving mechanism 53 is provided for moving the photoreceptor drum 10 back and forth in the axis direction. With this arrangement, in the processing control, in the case where the toner density within the reference range becomes higher than the toner density outside the reference range, in the following image forming processes, the moving mechanism 53 is driven through the processing condition controlling circuit 30 of the control unit 15 so as to move the photoreceptor drum 10 back and forth in the axis direction. As a result, it is possible to reduce the difference in toner density between the region within the reference range and the regions outside the reference range, thus reducing the density nonuniformity on the image formed on the sheet.

As described in above First through Tenth Embodiment, in the present invention, even in the case where the surface of the photoreceptor is worn and deteriorated unevenly in a direction orthogonal to the sheet transporting direction due to the fact that a sheet having a particular size is used frequently, processing conditions are controlled individually with respect to each region which is worn and deteriorated differently from one another. As a result, it is possible to uniformly maintain the image forming conditions in a direction orthogonal to the sheet transporting direction, thus always obtaining a desirable image.

Also, since the amount of charge on the surface of the photoreceptor, which affects the developer density, is controlled individually with respect to the plurality of regions in accordance with the wear and deterioration on the surface of the photoreceptor, the developer density is maintained uniformly with respect to the entire surface of the photoreceptor. As a result, it is possible to uniformly maintain the image forming conditions in a direction orthogonal to the sheet transporting direction, thus always obtaining a desirable image.

Also, since the transfer efficiency when a developer image is transferred onto the upper surface of the sheet from the surface of the photoreceptor is individually controlled with respect to the plurality of regions in accordance with the wear and deterioration on the surface of the photoreceptor, the amount of developer transferred is uniformly maintained with respect to the entire surface of the sheet. As a result, it is possible to uniformly maintain the image forming conditions in a direction orthogonal to the sheet transporting direction, thus always obtaining a desirable image.

Further, since the amount of exposing light, which affects the developer density on the surface of the photoreceptor, is individually controlled with respect to the plurality of regions in accordance with the wear and deterioration on the surface of the photoreceptor, the developer density is maintained uniformly with respect to the entire surface of the photoreceptor. As a result, it is possible to uniformly maintain the image forming conditions in a direction orthogonal to the sheet transporting direction, thus always obtaining a desirable image.

Furthermore, since the amount of developer supplied, which affects the developer density on the surface of the photoreceptor, is individually controlled with respect to the plurality of regions in accordance with the wear and deterioration on the surface of the photoreceptor, the developer density is maintained uniformly with respect to the entire surface of the photoreceptor. As a result, it is possible to uniformly maintain the image forming conditions in a direction orthogonal to the sheet transporting direction, thus always obtaining a desirable image.

Also, since the charge eliminating efficiency, which affects the developer density on the surface of the photoreceptor, is individually controlled with respect to the plurality of regions in accordance with the wear and deterioration on the surface of the photoreceptor, the developer density is maintained uniformly with respect to the entire surface of the photoreceptor. As a result, it is possible to uniformly maintain the image forming conditions in a direction orthogonal to the sheet transporting direction, thus always obtaining a desirable image.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus for forming a toner patch on a surface of a photoreceptor at a predetermined timing, and detecting density of the toner patch so as to control process conditions in an image forming process in an electrophotographic printing system, comprising:

controlling means for forming a toner patch on respective regions within and outside a reference range, in a direction orthogonal to a sheet transporting direction on the surface of the photoreceptor, which has been determined in accordance with a size of a sheet and frequency of the sheet used so as to carry out a control of process conditions in accordance with density of the toner patch with respect to the respective regions within and outside the reference range.

2. The image forming apparatus as set forth in claim 1, wherein the reference range is determined in accordance with a size of a sheet which is most frequency used.

3. The image forming apparatus as set forth in claim 1, further comprising a main charger, wherein said controlling means individually controls charger output of said main charger with respect to the respective regions within and outside the reference range in accordance with a result of detection of density of the toner patch of the respective regions within and outside the reference range.

4. The image forming apparatus as set forth in claim 3, wherein said main charger includes a first charger corresponding to a region within the reference range and a second charger corresponding to a region outside the reference range.

5. The image forming apparatus as set forth in claim 4, wherein said main charger further includes supporting means for (1) fixing the first charger to a position a predetermined distance away from the photoreceptor and (2) supporting the second charger so that the second charger is movable in a direction towards or away from the photoreceptor, wherein said controlling means controls the supporting means so as to adjust a distance between the second charger and the photoreceptor in accordance with a result of detection of the toner patch density.

6. The image forming apparatus as set forth in claim 3, wherein said main charger includes a main charger line corresponding to both regions within and outside the reference range and sub charger lines corresponding to the regions outside the reference range, and said controlling means applies, in a case where the toner patch density within the reference range is higher than the toner patch density outside the reference range, a charging voltage to the main charger line and the sub charger lines.

7. The image forming apparatus as set forth in claim 1, further comprising a transfer charger, wherein said controlling means individually controls transfer efficiency with respect to the respective regions within and outside the reference range in accordance with a result of detection of density of the toner patch of the respective regions within and outside the reference range.

8. The image forming apparatus as set forth in claim 7, wherein a shutter for carrying out an opening and closing operation is provided between said transfer charger and the photoreceptor, and said controlling means controls an opening area of the shutter in accordance with a result of detection of the toner patch density.

9. The image forming apparatus as set forth in claim 7, wherein said transfer charger includes a first charger line corresponding to the region within the reference range and a second charger line corresponding to a region outside the reference range.

10. The image forming apparatus as set forth in claim 7, wherein said transfer charger includes a main charger line corresponding to both regions within and outside the reference range and sub charger lines corresponding to the regions outside the reference range, and said controlling means applies, in a case where the toner patch density within the reference range is higher than the toner patch density outside the reference range, a charging voltage to the main charger line and the sub charger lines.

11. The image forming apparatus as set forth in claim 7, further comprising a pre-transfer charger for carrying out corona discharge of a charge having an opposite polarity to a charge holding a developer image on the surface of the photoreceptor, wherein said controlling means controls, in a case where the toner patch density within the reference range is higher than the toner patch density outside the reference range, said pre-transfer charger so that corona discharge is carried out with respect to the regions outside the reference range on the surface of the photoreceptor.

12. The image forming apparatus as set forth in claim 7, further comprising a sheet supplying guide with a variable sheet supplying angle with respect to the photoreceptor, for guiding a sheet to a spacing between the photoreceptor and the transfer charger, wherein said controlling means controls said sheet supplying guide so as to adjust the sheet supplying angle with respect to the photoreceptor in accordance with a result of detection of the toner patch density.

13. The image forming apparatus as set forth in claim 1, further comprising exposing means, wherein said controlling means individually controls an exposure amount for the respective regions within and outside the reference range in accordance with a result of detection of density of the toner patch of the respective regions within and outside the reference range.

14. The image forming apparatus as set forth in claim 13, wherein said exposing means includes a first light source facing a surface of a document image within the reference range and a second light source facing the surface of the document image outside the reference range.

15. The image forming apparatus as set forth in claim 13, wherein said exposing means includes a main light source corresponding to both regions within and outside the reference range and a sub light source corresponding to the region within the reference range, and said controlling means controls, in a case where the toner patch density within the reference range is higher than the toner patch density outside the reference range, said exposing means so as to light the main light source and the sub light source.

16. The image forming apparatus as set forth in claim 13, wherein said exposing means includes a laser light source and a polygon mirror for allowing light from the laser light source to scan the surface of the photoreceptor in a direction orthogonal to the sheet transporting direction, and said controlling means controls said exposing means so as to adjust, in accordance with a result of detection of the toner patch density, (a) output of the laser light source while the region within the reference range is being scanned by the light from the laser light source and (b) output of the laser light source while the region outside the reference range is being scanned.

17. The image forming apparatus as set forth in claim 1, further comprising developer supplying means for supplying developer to the photoreceptor, wherein said controlling means individually controls an amount of developer supplied with respect to the respective regions within and outside the reference range on the surface of the photoreceptor in accordance with a result of detection of density of the toner patch of respective regions within and outside the reference range.

18. The image forming apparatus as set forth in claim 17, wherein said developer supplying means includes (i) a development sleeve, (ii) a first doctor for regulating an amount of developer adhered to a position on a surface of the development sleeve corresponding to the region within the reference range on the photoreceptor, and (iii) a second doctor for regulating an amount of developer adhered to a portion on the surface of the development sleeve corresponding to a region outside the reference range.

19. The image forming apparatus as set forth in claim 18, wherein said developer supplying means further includes supporting means for fixing the first doctor to a position a predetermined distance away from the surface of the development sleeve, and for supporting the second doctor so that the second doctor is movable in a direction towards or away from the surface of the development sleeve, and said controlling means controls the supporting means so as to adjust a distance between the second doctor and the development sleeve in accordance with a result of detection of the toner patch density.

20. The image forming apparatus as set forth in claim 17, wherein said developer supplying means includes a development sleeve and voltage applying means for applying a voltage to the development sleeve, and a first region corresponding to a region within the reference range on the photoreceptor and a second region corresponding to a region outside the reference range on the photoreceptor are separated by non-conductive materials on a surface of the development sleeve, and the voltage applying means individually applies a voltage to the first region and the second region.

21. The image forming apparatus as set forth in claim 1, further comprising charge eliminating means for eliminating charge on the surface of the photoreceptor, wherein said controlling means individually controls charge eliminating efficiency with respect to the respective regions within and outside the reference range on the surface of the photoreceptor in accordance with a result of detection of density of the toner patch of the respective regions within and outside the reference range.

22. The image forming apparatus as set forth in claim 21, wherein said charge eliminating means is provided on a position facing the regions outside the reference range on the surface of the photoreceptor, and includes a light source for reducing the charge on the surface of the photoreceptor by a photoconductive effect, and said controlling means controls, in a case where the toner patch density within the reference range is higher than the toner patch density outside the reference range, said charge eliminating means so as to light the light source.

23. The image forming apparatus as set forth in claim 21, wherein said charge eliminating means includes a first light source for projecting light onto the region within the reference range on the photoreceptor so as to remove remaining charge and a second light source for projecting light onto the region outside the reference range on the photoreceptor so as to remove remaining charge, and said controlling means controls said charge eliminating means so as to individually adjust a voltage applied to the first light source and the second light source in accordance with a result of detection of the toner patch density.

24. The image forming apparatus as set forth in claim 1, further comprising supporting means for supporting the photoreceptor so that the photoreceptor is movable back and forth in a direction orthogonal to the sheet transporting direction, wherein said controlling means controls, in a case where the toner patch density within the reference range is higher than the toner patch density outside the reference range, said supporting means so as to move the photoreceptor back and forth in a direction orthogonal to the sheet transporting direction.

25. The image forming apparatus as set forth in claim 3, wherein said main charger includes a first charger corresponding to a region within the reference range, a second charger corresponding to a region outside on one side of the reference range, and a third charger corresponding to a region outside on an other side of the reference range.

26. The image forming apparatus as set forth in claim 25, wherein said main charger further includes supporting means for (1) fixing the first charger to a position a predetermined distance away from the photoreceptor and (2) supporting the second and third chargers so that the second and third chargers are movable in a direction towards or away from the photoreceptor, wherein said controlling means controls the supporting means so as to adjust a distance between the second and third chargers and the photoreceptor in accordance with a result of detection of the toner patch density.

27. The image forming apparatus as set forth in claim 7, wherein said transfer charger includes a first charger line corresponding to a region within the reference range, a second charger line corresponding to a region outside on one side of the reference range, and a third charger line corresponding to a region outside on an other side of the reference range.

28. The image forming apparatus as set forth in claim 13, wherein said exposing means includes a first light source facing a surface of a document image within the reference range, a second light source facing the surface of the document image outside on one side of the reference range, and a third light source facing the surface of the document image outside on an other side of the reference range.

29. The image forming apparatus as set forth in claim 17, wherein said developer supplying means includes (i) a development sleeve, (ii) a first doctor for regulating an amount of developer adhered to a portion on a surface of the development sleeve corresponding to the region within the reference range on the photoreceptor, (iii) a second doctor for regulating an amount of developer adhered to a portion on the surface of the development sleeve corresponding to a region outside on one side of the reference range, and (iv) a third doctor for regulating an amount of developer adhered to a portion on the surface of the development sleeve corresponding to a region outside on an other side of the reference range.

30. The image forming apparatus as set forth in claim 29, wherein said developer supplying means further includes supporting means for fixing the first doctor to a position a predetermined distance away from the surface of the development sleeve, and for supporting the second and third doctors so that the second and third doctors are movable in a direction toward or away from the surface of the development sleeve, and said controlling means controls the supporting means so as to adjust a distance between the second the third doctors and the development sleeve in accordance with a result of detection of the toner patch density.

31. The image forming apparatus as set forth in claim 17, wherein said developer supplying means includes a development sleeve and voltage applying means for applying a voltage to the development sleeve, and wherein (i) a first region corresponding to the region within the reference range on the photoreceptor and (ii) a second region corresponding to a region outside on one side of the reference range on the photoreceptor and a third region corresponding to a region outside on an other side of the reference range on the photoreceptor are separated by non-conductive materials on a surface of the development sleeve, and the voltage applying means individually applies a voltage to (a) the first region and (b) the second and third regions.

32. The image forming apparatus as set forth in claim 21, wherein said charge eliminating means includes (i) a first light source for projecting light onto the region within the reference range on the photoreceptor, (ii) a second light source for projecting light onto a region outside on one side of the reference range on the photoreceptor, and (iii) a third light source for projecting light onto a region outside on an other side of the reference range on the photoreceptor, so as to remove remaining charge, and wherein said controlling means controls said charge eliminating means so as to individually adjust a voltage applied to (a) the first light source and (b) the second and third light sources in accordance with a result of detection of the toner patch density.

* * * * *